United States Patent [19]

Forsberg

[11] Patent Number: 4,776,413

[45] Date of Patent: Oct. 11, 1988

[54] BUTTON INSERT FOR ROCK DRILL BITS

[75] Inventor: Göran S. Forsberg, Gävle, Sweden

[73] Assignee: Santrade Limited, Lucerne, Switzerland

[21] Appl. No.: 904,018

[22] Filed: Sep. 2, 1986

[30] Foreign Application Priority Data

Sep. 2, 1985 [SE] Sweden ..... 8504058

[51] Int. Cl.[4] ..... E21B 10/52

[52] U.S. Cl. ..... 175/410

[58] Field of Search ..... 175/374, 409, 410, 411; 72/71

[56] References Cited

U.S. PATENT DOCUMENTS

| | | | |
|---|---|---|---|
| 2,689,109 | 9/1954 | Curtis | 175/410 |
| 3,006,424 | 10/1961 | Dahlin et al. | 175/410 |
| 3,388,757 | 6/1968 | Fittinger | 175/410 |
| 3,442,342 | 5/1969 | McElya et al. | 175/410 |
| 4,108,260 | 8/1978 | Bozarth | 175/410 |
| 4,254,840 | 3/1981 | Shay, Jr. | 175/410 |
| 4,375,242 | 3/1983 | Galle | 175/228 |
| 4,406,337 | 9/1983 | Dill | 175/410 |
| 4,570,726 | 2/1986 | Hall | 175/410 |
| 4,595,067 | 6/1986 | Drake | 175/374 |

FOREIGN PATENT DOCUMENTS

| | | | |
|---|---|---|---|
| 0122893 | 10/1984 | European Pat. Off. . | |
| 0791889 | 12/1980 | U.S.S.R. | 175/410 |
| 2138054 | 10/1984 | United Kingdom . | |

*Primary Examiner*—Stephen J. Novosad
*Assistant Examiner*—Terry Lee Melius
*Attorney, Agent, or Firm*—Burns, Doane, Swecker & Mathis

[57] ABSTRACT

A button insert (10) for rock drill bits comprising a base portion (11) intended to be secured in the body of the drill bit and a cutting tip (12) being integral with the base portion (11). The cutting tip (12) comprises a portion (13) that is concave in an arbitrary longitudinal section through the button insert (10).

13 Claims, No Drawings

BUTTON INSERT FOR ROCK DRILL BITS

BACKGROUND OF THE INVENTION

The present invention relates to a button insert for rock drill bits comprising a base portion intended to be secured in the body of the drill bit and a unit integral with the base portion constituting a cutting tip.

The button insert is primarily intended to be used in connection with rotating drill bits, i.e. roller bits and bits for raise boring and tunnelling. However, the button insert could also with preference be used with drill bits for percussion drilling.

At present a frequent insert design in rotating bits has a cylindrical base portion and a substantially conical cutting tip, the sharp edges of the truncated cone being trued thereby providing a relatively blunt tip. By another frequent insert design, said inserts have a substantially semi-spherical cutting tip. These two button insert designs are for instance illustrated in U.S. Pat. No. 4,375,242. The first-mentioned button insert design is mostly used when drilling in soft and medium hard formations while the last-mentioned button insert design mostly is used when drilling in hard formations.

There are many modifications of these two basic designs. A common modification of the truncated, conical cutting tip is that opposite sides of the cutting tip are planed thereby providing a chisel-shaped cutting tip. A button insert design of this type is for instance illustrated in U.S. Pat. No. 4,406,337.

In U.S. Pat. No. 4,254,840 a button insert design is disclosed that makes an attempt to unite the characteristics of semi-sperical and chisel-shaped cutting tips.

A special modification of the chisel-shaped cutting tip is disclosed in U.S. Pat. No. 4,108,260 having the face directed forward in the direction of revolution concave and the opposite face convex. By this button insert design a high bending resistance is pursued and this is achieved by the extra support that is given because of the convex face and due to the concave face being designed simultaneously to raise the cuttings.

Still another button insert design for soft and medium hard and also hard formations is disclosed in U.S. Pat. No. 3,388,757, the button insert being provided with a number of planar or slightly concave bevellings that are separated by crests, said crests being intended to act as cutting edges during drilling.

In German application No. 3,317,441 a cutting insert is disclosed intended to be used in tools for breaking solid materials, e.g. asphalt. This cutting insert comprises a conical cutting tip and a shoulder intended to abut against the tool body. Between the cutting tip and the shoulder there is an intermediate portion comprising a concave portion. The intermediate portion is intended to maintain the required cutting force at a low level even when the cutting tip is worn.

The present invention should be regarded as a modification of a button insert having a truncated concical cutting tip.

The aim of the invention is to provide a button insert that is subjected to a more evenly spread stress caused by a lateral load compared to the conditions of button inserts having conventionally designed conical cutting tips.

Another aim of the invention is to, when comparing the conditions in button inserts having conventionally designed concical cutting tips, reduce the required force to penetrate the button insert to a given depth at both straight as well as inclined penetration of the button insert into the formation.

Still another aim of the invention is to, when comparing the condition of a button insert having conventionally designed conical cutting tips, reduce the required force to displace the button insert perpendicular to its longitudinal axis after the penetration in the formation.

Further aims are to achieve a button insert having generally seen concical cutting tip shape that clears from the formation as fast as possible after the previous penetration, is worn blunt slowly in order to maintain a high penetration rate for a long time, allows a large, accessible free space for cuttings around the button inserts, and in rotational drilling, between the cone and the formation for providing an effective flushing, a smaller amount of hard material is required thereby making the button insert inexpensive and also that the breaking stress caused by bending relatively seen is increasing due to the smaller amount of hard material.

The invention is described more in detail in the following with reference to the accompanying drawings disclosing an embodiment by way of example. Said embodiment is only intended to illustrate, the invention that can be modified within the scope of the claims.

THE DRAWINGS

In the drawings:

FIG. 1 discloses a side view of a button insert according to the invention.

DESCRIPTION OF A PREFERRED EMBODIMENT OF THE INVENTION

Figure 1:
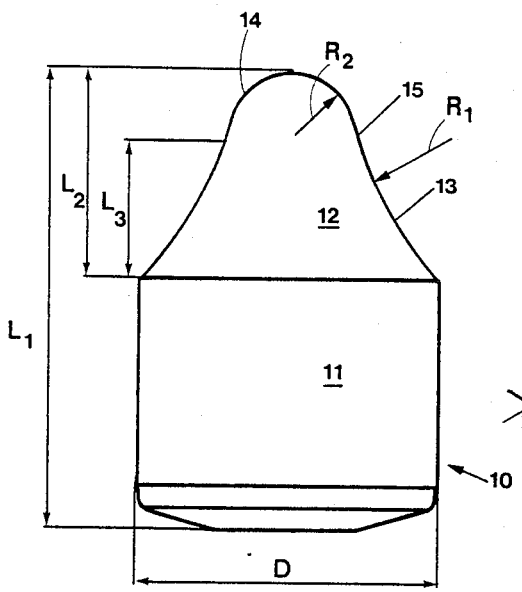

The insert generally indicated by the reference numeral 10 comprises a base portion 11 and a cutting tip 12, said base portion 11 and said cutting tip 12 forming an integral unit. The base portion is in a conventional matter cylindrical and intended to be secured by force fit in a boring in a body of a rock drill bit.

The insert 10 is primarily intended to be used with rotating drill bits, said insert being secured in a cone of a roller bit. The advantages of the insert and its mode of operation are therefore described in the following in connection with such drill bits. Generally, it can be stated that the cutting tip 12 in an insert according to the invention comprises a portion 13 that is concave in an arbitrary longitudinal section through the insert 10, i.e. the envelope surface is concave at the portion 13.

Figure 2:
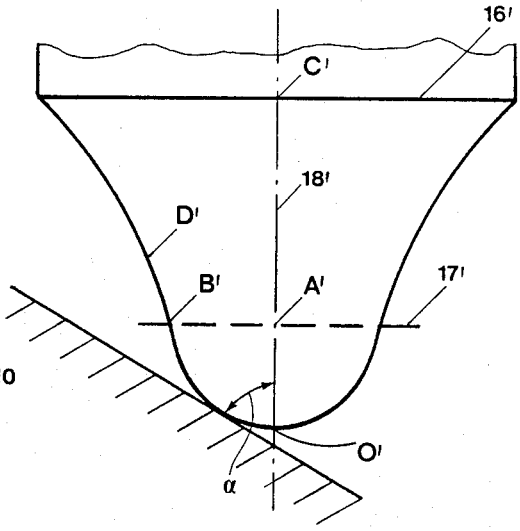
FIGS. 2 and 3 illustrate inclined penetration in the formation of the cutting tip of a button insert of the invention and a button insert having a conventional conical cutting tip, respectively
Figure 4:
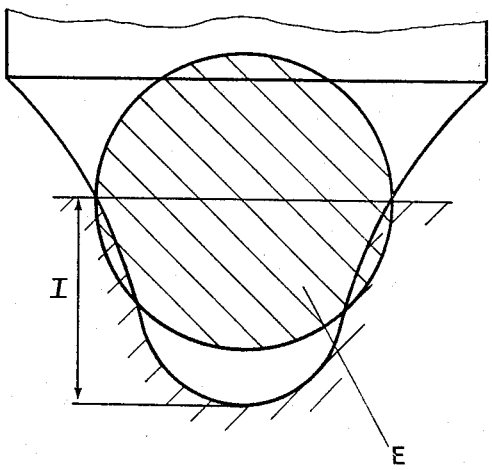
FIGS. 4 and 5 illustrate straight penetration in the formation of the cutting tip of a button insert according to the invention, and a button insert having a conventional conical cutting tip, respectivly.

The portion 13 is preferably continuously curved and extends to the base portion 11. The portion 13 is of an uninterrupted concave shape for 360 degrees around the circumference of the tip as depicted in FIGS. 1, 2 and 4. In the disclosed embodiment the portion 13 has a constant radius of curvature $R_1$, said radius being shorter than the overall length $L_1$ of the insert, preferably in the range of 50%–95% of the overall length $L_1$. The radius $R_1$ is longer than the length $L_2$ of the cutting tip, preferably in the range of 125%–200% of said length $L_2$, and/or that said radius $R_1$ is in the same magnitude as the diameter D of the insert 10, preferably 75%–125% of said diameter D. In the disclosed embodiment $R_1$ is about 75% of $L_1$, about 160% of $L_2$ and about 110% of D. As typical values of $R_1$, $L_1$, $L_2$ and D can be mentioned 15 mm, 19.5 mm, 9.5 mm and 14 mm, respectively.

In the illustrated embodiment the nose portion 14 of the cutting tip 12 is generally semi-spherical having a radius of curvature $R_2$ that is essentially shorter than the radius of curvature $R_1$ for the concave portion 13. In the illustrated embodiment $R_2$ is in the range of one fifth of $R_1$ and as a typical value for $R_2$ can be mentioned 3 mm. Further the axial extension $L_3$ of the concave portion 13 exceeds half the axial extension (i.e., $L_2/2$) for the cutting tip 12, with preference for values in the range of 75% of $L_2$. The radial extension $R_2$ of the nose portion 14 of the cutting tip 12 is between 30% and 50% of the radial extension D/2 of the concave portion 13, preferably in the range of 40%. In the illustrated embodiment the axial extension $L_3$ of the concave portion 13 is in the same range as the radial extension D/2 of the portion 13.

In a prefered embodiment the transition between the convex limiting line of the nose portion 14 and the concave limiting line of the concave portion 14 provides a point of inflection 15. Further, the cutting tip 12 is symmetrical of rotation.

As is depicted in the various drawings, the cross-section of the cutting tip narrows from a point adjacent the base portion to a point adjacent the nose portion. Further, the cutting tip is substantially continuously curved along its periphery from the base portion to the nose portion.

Figure 3:
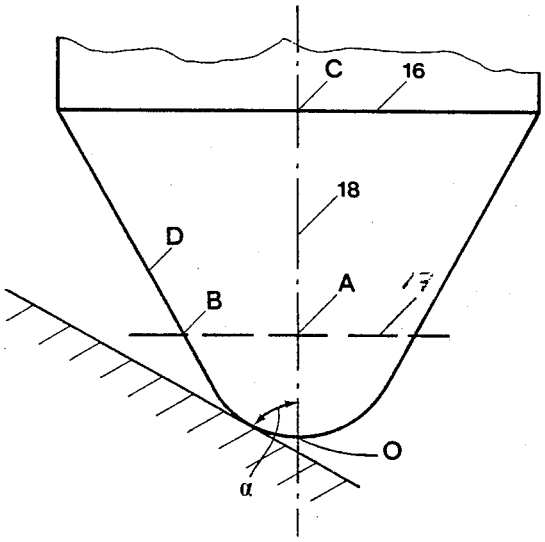

The present invention intends to provide an insert having the effective stress emanating from lateral loads as evenly spread as possible. This stress is generated partly from the bending forces acting on the insert and partly from the shearing forces acting on the insert. Studies of the effective stress in inserts having conventionally designed conical tips show that the stress at the conical portion between the lines 16, 17 in FIG. 3 varies strongly. In order to get comparable figures the lines 16, 16' and the lines 17, 17' are located at the same distance from the top of the cutting tip, i.e. the intersection point O between the cutting tip and the longitudinal axis 18 of the insert. Further, the radii of the nose portion 14 as well as the diameters of the inserts are the same. It has been found that the effective stress at the intersection between the line 17 and the longitudinal axis 18 of the insert, i.e. at point A in FIG. 3, is in the magnitude of four times the effective stress at point B in FIG. 3, i.e. at the intersection between the line 17 and the envelope surface of the insert. In an insert according to the invention having the design of FIG. 2, $R_1$ being 15 mm and D being 14 mm, the ratio between the effective stresses at corresponding points A' and B' is on the contrary in the magnitude of 2.3. Further, the effective stress at point A is in the range of 25% higher than the effective stress at point A'. The stresses decrease from the points A, A' in direction rearwards along the longitudinal axis of the insert, and at the intersection C, C' between said longitudinal axis and the transverse lines 16, 16' said stresses are substantially equal. Along the envelope surface of the insert the effective stress is highest at points D, D' located somewhat behind the points B, B', the stress at pcint D is in the magnitude of 45% of the stress at point A, while the stress at point D' is in the magnitude of 90% of the stress at point A'. Thus the maximum stress is lower and also the stress is more evenly spread in an insert according to the present invention as compared to the conditions in an insert having a conventionally designed conical cutting tip. In the calculations it has been assumed that both inserts have been subjected to the same lateral force that has been acting at the same distance from the securing of the inserts in the bit body This improved stress configuration results in an essentially longer life for the insert. Alternatively the insert can be given smaller dimensions and resulting in less consumption of material and consequently less expensive inserts having a maintained length of life.

As can be seen in FIGS. 2 and 3 the projected area increases more slowly in an insert according to the present invention compared to the conditions in an insert having a conventionally designed conical cutting tip when the inserts are penetrated into the formation at an inclined position. FIGS. 2 and 3 disclose an embodiment having an angle between the longitudinal axis 18 and the surface of the formation of 60°. This results in that a smaller force is required for penetrating an insert of the invention to a certain depth, and consequently a lower force is acting on the insert and its securing.

Figure 5:
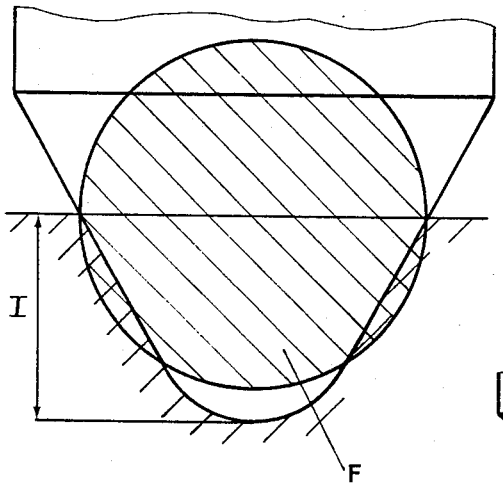

As can be seen from FIGS. 4 and 5 the projected area is smaller in an insert according to the present invention than in the conventional insert when the inserts are penetrated straight into the formation. The projected areas are marked E and F, respectively, for a penetration depth I. It is understood that the area E is essentially smaller than the area F for most values of the penetration depth I. Thus, a smaller force is required for penetrating an insert according to the invention a given depth. Alternatively one can penetrate said insert deeper when applying a given force. This results in a more effective and faster drilling.

Figure 6:
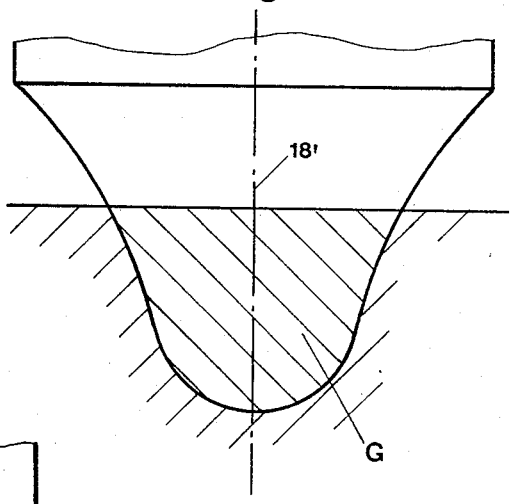
FIGS. 6 and 7 illustrate the projected area that is achieved from a button insert according to the invention and a button insert having a conventional conical cutting tip, respectively, when the button insert after penetration in the formation is displaced perdicular to its longitudinal axis.
Figure 7:
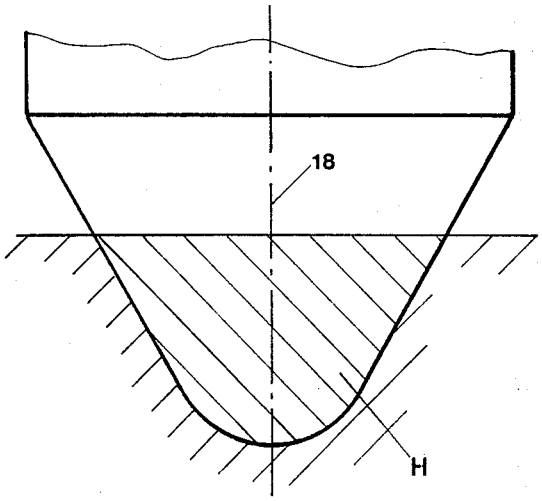
Figure 1:
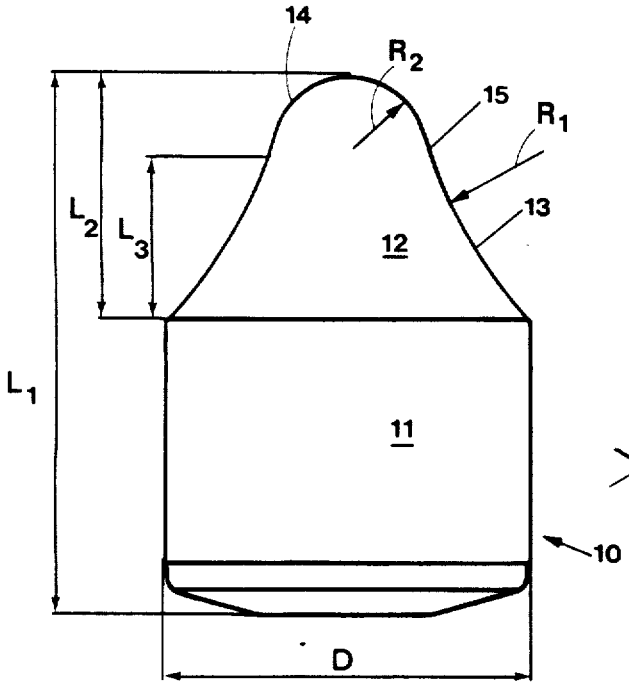
Figure 2:
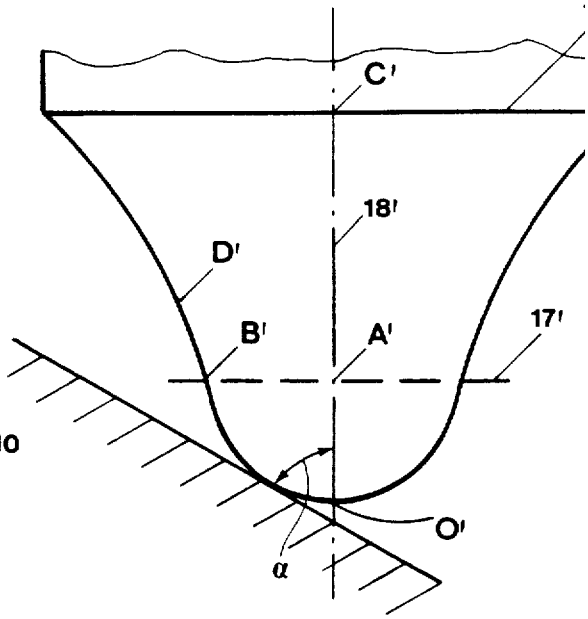
Figure 4:
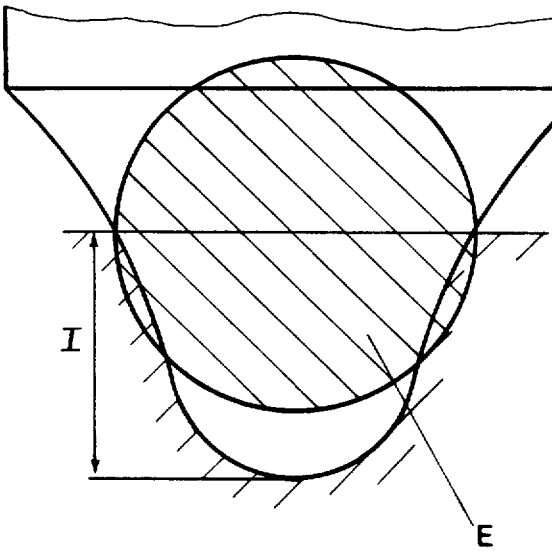
Figure 3:
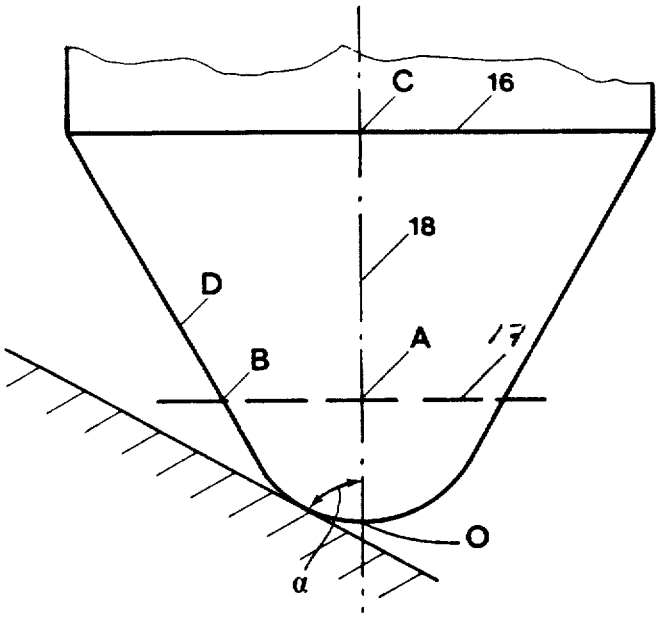
Figure 5:
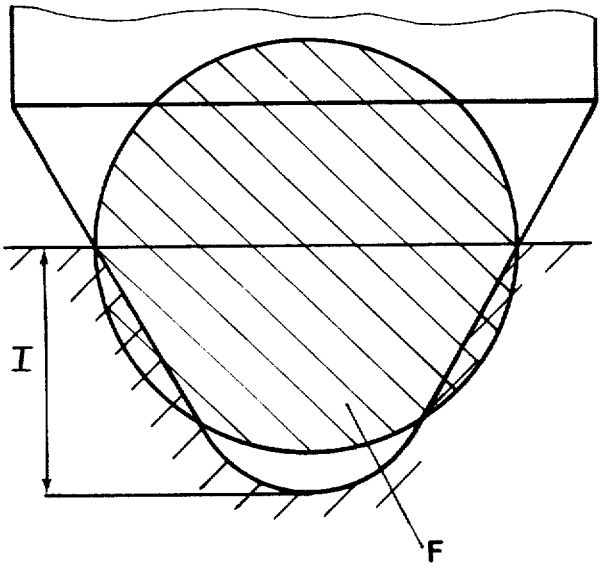
Figure 6:
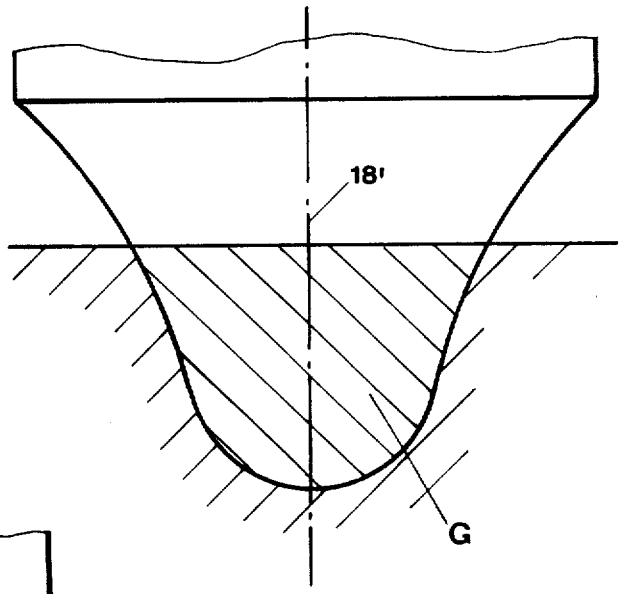
Figure 7:
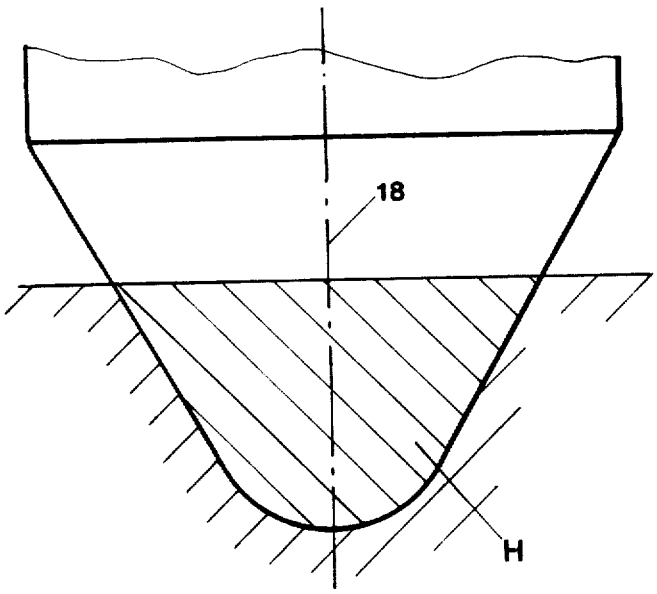

As can be seen from FIGS. 6 and 7 the projected area G, being generated when after penetration the insert is displaced in a directed perpendicular to its longitudinal axis 18, is smaller than the corresponding area H of the conventional insert. This results in that a lower force is required and consequently a more effective and faster drilling is achieved. Also there is a lower force on the insert and its securing.

Another result of the concave design of the envelope surface of a button insert according to the invention is that more favorably conditions for the button insert and its securing are achieved when the button insert leaves the formation after the previous penetration due to the fact that the button insert "clears out" earlier than the conventional insert having a concavity equal to zero.

Further results from the concave design of the envelope surface of a button insert according to the invention are that the insert will not be worn blunt equally fast as the conventional insert, thus maintaining a high penetration rate for a longer time, and also that the free, available space for cuttings around the button inserts and between the cone and the formation is larger than in the conventional insert, thus achieving a more efficient flushing.

Other advantages due to the concave design of the envelope surface of a button insert according to the invention are that a smaller amount of hard material is required resulting in a less expensive button insert having, relatively seen, a somewhat increasing breaking stress caused by bending.

As mentioned above the invention can also with preference be used in connection with drill bits for percussion drilling.

I claim:

1. A button insert for rock drill bits, said insert comprising a one-piece unit including a base portion mountable in a drill bit body and an integral cutting tip projecting longitudinally forwardly from said base portion, said cutting tip including an outer surface which is of an uninterrupted concave shape for 360 degrees around the circumference of said cutting tip, said cutting tip having a free end disposed opposite said base and wherein the cross-section of said cutting tip continually narrows from substantially adjacent said base portion to substantially, substantially adjacent said free end.

2. Button insert according to claim 1, wherein said cutting tip includes a convex nose at a front end of said concave surface.

3. Button insert according to claim 1, wherein said concave surface is continuously curved from rear to front.

4. Button insert according to claim 3, wherein said concave surface has a constant radius of curvature which is shorter than the overall longitudinal length of the insert, longer than the longitudinal length of the cutting tip, and longer than the diameter of the insert.

5. Button insert according to claim 1, wherein said cutting tip includes a semi-spherical nose having a radius of curvature of the concave surface.

6. Button insert according to claim 5, wherein said radius of curvature of said nose is about one-fifth of the radius of curvature of said concave surface.

7. Button insert according to claim 5, wherein said nose has a radius of curvature in a range of from 30 to 50 percent of the largest radial extension of said concave surface.

8. Button insert according to claim 7, wherein said radius of curvature of said nose is about 40 percent of the largest radial extension of said concave surface.

9. Button insert according to claim 1, wherein said cutting tip is of symmetrical shape with respect to a longitudinal axis of said insert.

10. Button insert according to claim 1, wherein said concave surface has a longitudinal length which exceeds one-half of the longitudinal length of said cutting tip.

11. Button insert according to claim 10, wherein said longitudinal length of said concave surface is about 75 percent of said longitudinal length of said cutting tip.

12. Button insert according to claim 1, wherein a longitudinal length of said concave surface is substantially the same as the largest radial extension thereof.

13. Button insert according to claim 1 wherein said cutting tip is substantially continuously curved along its periphery from a point substantially adjacent said base portion to a point substantially adjacent said free end.

* * * * *

UNITED STATES PATENT AND TRADEMARK OFFICE

CERTIFICATE OF CORRECTION

PATENT NO. : 4,776,413

DATED : October 11, 1988

INVENTOR(S) : Goran S. Forsberg

It is certified that error appears in the above-identified patent and that said Letters Patent is hereby corrected as shown below:

The Title Page showing the illustrative figure should appear as shown on the attached sheet.

Insert Figures 1-7 as shown on the attached sheets.

Column 5, line 19, "substantially", second occurrence, should read -- immediately --.

Signed and Sealed this

Thirteenth Day of February, 1990

*Attest:*

JEFFREY M. SAMUELS

*Attesting Officer* *Acting Commissioner of Patents and Trademarks*

United States Patent [19]

Forsberg

[11] Patent Number: 4,776,41

[45] Date of Patent: Oct. 11, 198

[54] BUTTON INSERT FOR ROCK DRILL BITS

[75] Inventor: Göran S. Forsberg, Gävle, Sweden

[73] Assignee: Santrade Limited, Lucerne, Switzerland

[21] Appl. No.: 904,018

[22] Filed: Sep. 2, 1986

[30] Foreign Application Priority Data

Sep. 2, 1985 [SE] Sweden ..... 8504058

[51] Int. Cl.[4] ..... E21B 10/52

[52] U.S. Cl. ..... 175/410

[58] Field of Search ..... 175/374, 409, 410, 411; 72/71

[56] References Cited

U.S. PATENT DOCUMENTS

| | | | |
|---|---|---|---|
| 2,689,109 | 9/1954 | Curtis | 175/410 |
| 3,006,424 | 10/1961 | Dahlin et al. | 175/410 |
| 3,388,757 | 6/1968 | Fittinger | 175/410 |
| 3,442,342 | 5/1969 | McElya et al. | 175/410 |
| 4,108,260 | 8/1978 | Bozarth | 175/410 |
| 4,254,840 | 3/1981 | Shay, Jr. | 175/410 |
| 4,375,242 | 3/1983 | Galle | 175/22 |
| 4,406,337 | 9/1983 | Dill | 175/41 |
| 4,570,726 | 2/1986 | Hall | 175/41 |
| 4,595,067 | 6/1986 | Drake | 175/37 |

FOREIGN PATENT DOCUMENTS

| | | | |
|---|---|---|---|
| 0122893 | 10/1984 | European Pat. Off. . | |
| 0791889 | 12/1980 | U.S.S.R. | 175/41 |
| 2138054 | 10/1984 | United Kingdom . | |

*Primary Examiner*—Stephen J. Novosad
*Assistant Examiner*—Terry Lee Melius
*Attorney, Agent, or Firm*—Burns, Doane, Swecker & Mathis

[57] ABSTRACT

A button insert (10) for rock drill bits comprising a bas portion (11) intended to be secured in the body of th drill bit and a cutting tip (12) being integral with th base portion (11). The cutting tip (12) comprises a por tion (13) that is concave in an arbitrary longitudina section through the button insert (10).

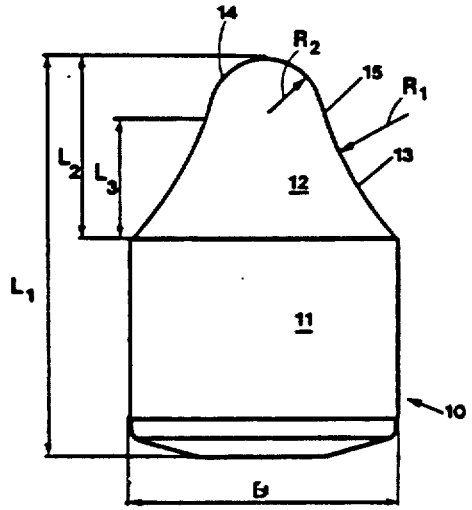

13 Claims, 2 Drawing Sheets